US005921468A

United States Patent [19]

Palestrant

[11] Patent Number: 5,921,468

[45] Date of Patent: Jul. 13, 1999

[54] ENHANCED LIFE CYCLE ATOMIZING NOZZLE

[76] Inventor: Nathan Palestrant, 5120 N. 79th Place, Scottsdale, Ariz. 85250

[21] Appl. No.: 08/832,238

[22] Filed: Apr. 3, 1997

[51] Int. Cl.[6] ..... B05B 1/34

[52] U.S. Cl. ..... 239/383; 239/600

[58] Field of Search ..... 239/271, 272, 239/276, 380, 381, 383, 461, 463, 490, 547, 552, 553, 550, 566, 600

[56] References Cited

U.S. PATENT DOCUMENTS

| | | | |
|---|---|---|---|
| 3,249,305 | 5/1966 | Baker | 239/566 X |
| 3,693,888 | 9/1972 | Rondas et al. | 239/547 X |
| 4,702,034 | 10/1987 | Ferguson et al. | 239/276 X |
| 4,721,250 | 1/1988 | Kennedy et al. | 239/383 |
| 5,143,293 | 9/1992 | Pairis | 239/493 X |
| 5,154,356 | 10/1992 | Sorenson | 239/550 |
| 5,810,259 | 9/1998 | Sinclair | 239/383 |

*Primary Examiner*—Andres Kashnikow
*Assistant Examiner*—Steven J. Ganey
*Attorney, Agent, or Firm*—Meschkow & Gresham, P.L.C.; Jordan M. Meschkow; Lowell W. Gresham

[57] ABSTRACT

A misting system (20) includes an atomizing nozzle (22) having a one-piece body (28). The one-piece body (28) has a passage (34) in which a plunger (36) resides and an atomizing orifice (30). The plunger (36) is inserted into the body from a fluid inlet end (38) of the body (28). A retainer (40) couples to the fluid inlet end (38) of the body (28) so that fluid flow into the passage (34) is not blocked but movement of the plunger (36) out of the passage is blocked. The retainer (40) may take a variety of forms, including a crimped portion of the body (28), a compressible elastic member (52, 72, 82), a cap (86) or plug (102).

4 Claims, 5 Drawing Sheets

ENHANCED LIFE CYCLE ATOMIZING NOZZLE

TECHNICAL FIELD OF THE INVENTION

The present invention relates generally to mist heads which atomize pressurized fluid. Specifically, the present invention relates to atomizing nozzles that are configured to exhibit enhanced life cycle characteristics.

BACKGROUND OF THE INVENTION

Atomizing nozzles, also called mist heads, are used in connection with misting systems to produce fog or at least a fine mist. Typically, water under pressure is forced through the atomizing nozzles to produce the mist. Desirably, the mist is sufficiently fine so that it rapidly evaporates. As the mist evaporates, the general area around the atomizing nozzles becomes cooler. Rapid evaporation prevents people and property located in the mist from getting wet and enhances the cooling effect. Accordingly, misting systems are often used for cooling and for increasing humidity.

In order to produce a fog or at least a fine mist that quickly evaporates, atomizing nozzles include a small orifice through which a fluid under high pressure passes as it exits the nozzle. In addition, a plunger, also called a poppet or impeller, is positioned within a passage that connects to the orifice. The action of the plunger within the passage helps break the fluid into a fog or fine mist.

The nature of the operation performed by atomizing nozzles causes them to become clogged on occasion, particularly when hard or unpurified water is used to produce the fog. In such cases, mineral deposits readily form in the exit orifice and around the plunger. When the orifice becomes clogged, little or no mist escapes and less cooling results. When the plunger becomes impeded, the resulting mist is often too coarse. People and property in the vicinity of the nozzle tend to get wet and less cooling results.

The occasional clogging is particularly burdensome in connection with conventional atomizing nozzles because conventional atomizing nozzles have undesirably poor life cycle characteristics. In particular, conventional atomizing nozzles used in misting systems tend to be complicated structures which are undesirably expensive to manufacture and purchase. Moreover, conventional atomizing nozzles used in misting systems tend to be uncleanable. Accordingly, conventional atomizing nozzles are expensive to acquire, become clogged before long, then must be thrown away because they cannot be unclogged.

Conventional atomizing nozzles use a multi-part construction which is, at least in part, responsible for the unfortunate life cycle of conventional atomizing nozzles. In a conventional atomizing nozzle, the nozzle body passage is restricted at a fluid inlet end of the nozzle to entrap the plunger in the passage. The plunger is placed in the passage from the exit end of the nozzle, and a separate orifice-bearing plug is press-fit into the passage from the exit end of the nozzle. The orifice-bearing plug is pressed into place with great force so that a fluid tight seal results even when the fluid is placed under great pressure. Because the orifice-bearing plug is a separate component which requires separate complex manufacturing steps to install, the conventional atomizing nozzle is undesirably expensive. Since the orifice-bearing plug is press fit with such great force, it cannot thereafter be removed. Consequently, the conventional atomizing nozzle is essentially uncleanable.

SUMMARY OF THE INVENTION

Accordingly, it is an advantage of the present invention that an improved atomizing nozzle with enhanced life cycle characteristics is provided.

Another advantage of the present invention is that an atomizing nozzle plunger is inserted into its passage from a fluid inlet end of the nozzle.

Another advantage of the present invention is that once inserted in the atomizing nozzle the plunger remains free floating for best atomization of water.

Another advantage of the present invention is that a one piece nozzle body has the plunger passage and atomizing fluid exit orifice formed in the one-piece body.

Another advantage of the present invention is that an atomizing nozzle which is inexpensive to manufacture and purchase and/or is cleanable is provided.

The above and other advantages of the present invention are carried out in one form by an enhanced life cycle atomizing nozzle which includes a body, a plunger, and a retainer. The body has an exit end and an inlet end. The exit end of the body has an orifice of a first diameter that connects to a passage having a second diameter. The second diameter is larger than the first diameter, and the passage extends from the orifice to the inlet end of the body. The plunger resides in the passage. The plunger has a diameter larger than the first diameter and smaller than said second diameter. The retainer is coupled to the body and retains the plunger in the passage.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
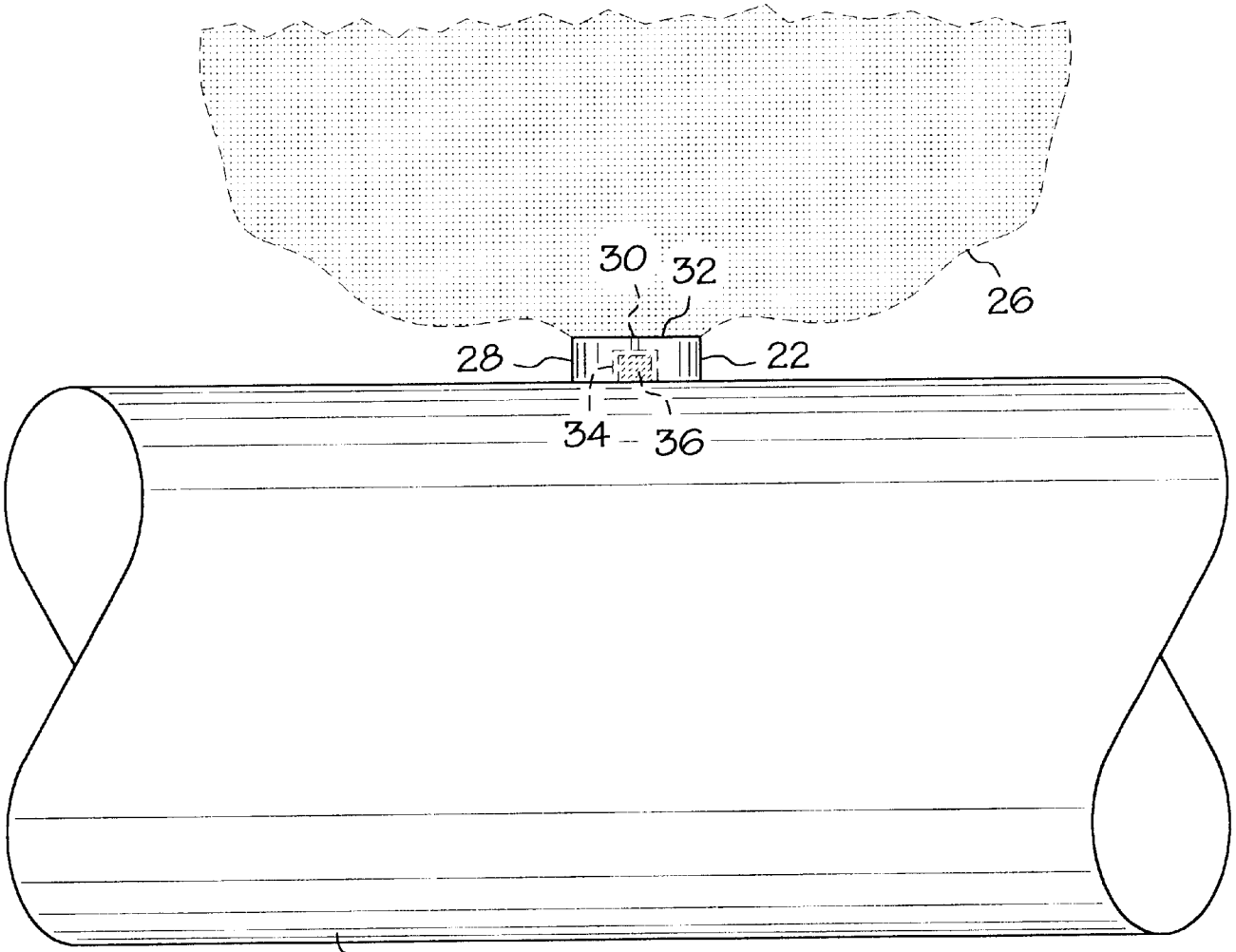
FIG. 1 shows a side view of a portion of a misting system in which an atomizing nozzle attaches to a pipe.

FIG. 1 shows a side view of a portion of a misting system 20 in which an atomizing nozzle 22 attaches to a pipe 24. A fluid (not shown) flowing in pipe 24 is under pressure. The fluid escapes from system 20 as a fine mist or fog 26 at nozzle 22. Fog 26 rapidly evaporates to cool the area around nozzle 22 without causing persons and property located in the in the area to get wet.

In the preferred embodiments, nozzle 22 has a hollow, one-piece body 28. A small atomizing orifice 30 is located at an exit end 32 of body 28. The fluid in system 20 escapes from nozzle 22 at orifice 30. Orifice 30 connects to an internal passage 34 within body 28. A plunger 36 resides in passage 34 and remains free floating within passage 34.

In the preferred embodiments, orifice 30 is a small circular hole, and both passage 34 and plunger 36 have cylindrical shapes with circular cross sectional areas. A diameter of passage 34 is greater than a diameter of plunger 36, which is significantly greater than the diameter of orifice 30. Plunger 36 moves in a free floating fashion within passage 34, and can slide or spin within passage 34, to cooperate with atomizing orifice 30 in atomizing the fluid which exits from system 20. Conventional enhancements to the shape and structure of plunger 36 which are known to those skilled in the art, such as the inclusion of notches and the like, can be applied to improve the atomization effect. Still, it is important to note that in all embodiments disclosed herein, plunger 36 is free floating to provide optimum atomization.

Since atomizing orifice 30 is formed in one-piece body 28, no separate plug or insert is press-fit into body 28 at exit end 32. Thus, one-piece body 28 simplifies construction to allow for reduced manufacture and purchase costs.

Figure 2:
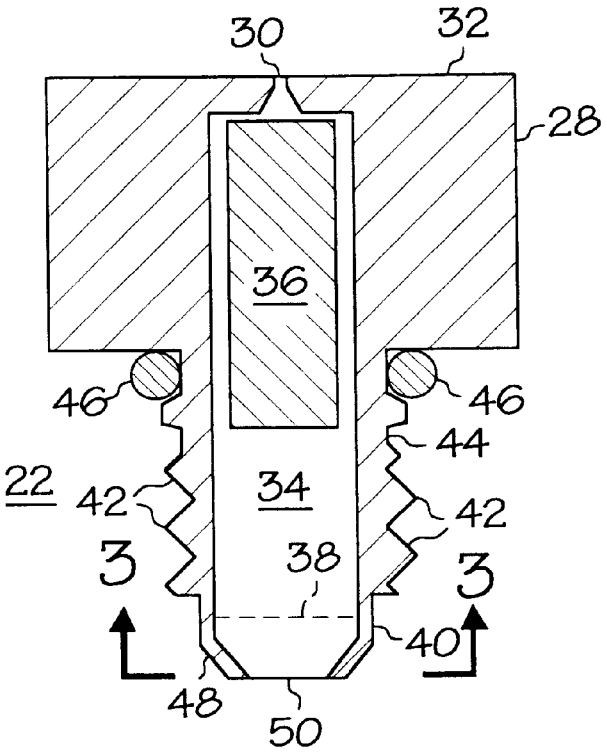
FIG. 2 shows a cross sectional side view of a first embodiment of an atomizing nozzle configured in accordance with the present invention.

FIG. 2 shows a cross sectional side view of a first embodiment of atomizing nozzle 22. FIG. 2 illustrates body 28, orifice 30, exit end 32, passage 34, and plunger 36 in greater detail than shown in FIG. 1. In particular, FIG. 2 illustrates that passage 34 extends from orifice 30 to an inlet end 38 of body 28. In this first embodiment, a dotted line shown in FIG. 2 denotes inlet end 38. A retainer 40 is integrally formed with body 28 at inlet end 38. In other words, retainer 40 may be viewed as an extended portion of body 28. FIG. 2 additionally illustrates outwardly formed threads 42 on a lower exterior wall 44 of body 28. An O-ring 46 surrounds body 28 on exterior wall 44 above threads 42. In the preferred embodiments of the present invention, nozzle 22 threadably engages mating threads (not shown) in pipe 24 (FIG. 1) to attach nozzle 22 to pipe 24. O-ring 46 insures that this attachment will form a fluid tight seal.

Assembly of nozzle 22 occurs prior to attachment to pipe 24. To assemble nozzle 22, plunger 36 is inserted into passage 34 from inlet end 38 of body 28, and then a crimping operation is performed on retainer 40 to constrict passage 34 in order to prevent passage of plunger 36 out from body 28. However, this crimping operation does not entirely constrict passage 34 so that fluid may easily enter nozzle 22 at inlet end 38.

Figure 3:
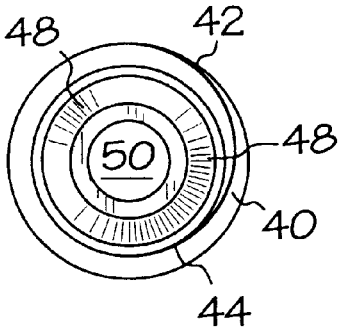
FIG. 3 shows a bottom end view of a portion of the atomizing nozzle shown in FIG. 2.

FIG. 3 shows a bottom end view of a portion of atomizing nozzle 22 taken at a line 3—3 shown in FIG. 2. Referring to FIGS. 2 and 3, retainer 40 has an outer wall 48 which surrounds an area 50. The crimping of retainer 40 is performed so that area 50 is smaller than the cross sectional area enclosed by threads 42. This smaller enclosed area ensures blockage of plunger 36 while not interfering with the threaded attachment of nozzle 22 to pipe 24.

Accordingly, nozzle 22 as configured in accordance with this first embodiment of the present invention exhibits enhanced life cycle characteristics. In particular, this first embodiment of nozzle 22 is simple and inexpensive due to the use of one-piece body 28 having atomizing orifice 30 formed therein. While plunger 36 is not intended to be removed from body 28 in this first embodiment of nozzle 22, the low cost resulting from a simple design justifies a shorter life cycle when compared to a more complex and expensive design.

Figure 4:
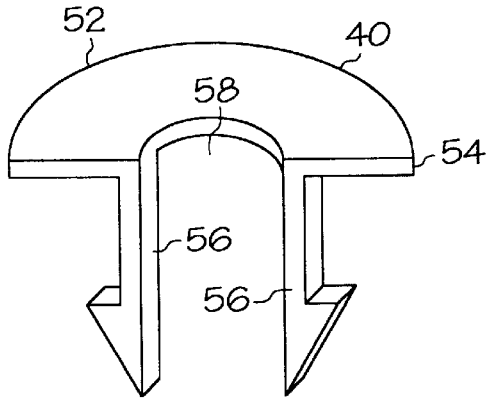
FIG. 4 shows a cross sectional perspective view of a compressed elastic member used in connection with a second embodiment of an atomizing nozzle configured in accordance with the present invention.
Figure 5:
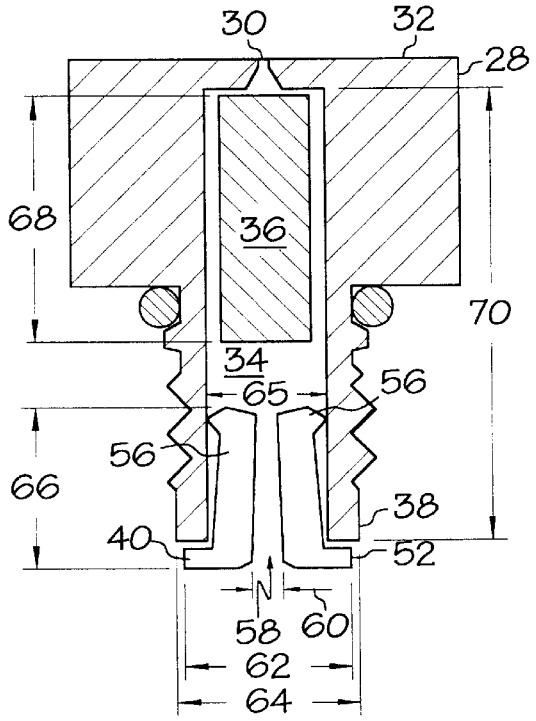
FIG. 5 shows a cross sectional side view of the second embodiment of the atomizing nozzle.

FIG. 4 shows a cross sectional perspective view of a compressed elastic member 52 used in connection with a second embodiment of atomizing nozzle 22, and FIG. 5 shows a cross sectional side view of the second embodiment of atomizing nozzle 22. Referring to FIGS. 4 and 5, this second embodiment of nozzle 22 differs from the first embodiment discussed above in connection with FIGS. 2 and 3 in the use of an alternate retainer 40. In particular, compressed elastic member 52 serves as retainer 40 in this second embodiment.

Member 52 includes a flange 54 coupled to first and second fingers 56. Member 52 is installed in nozzle 22 by being pressed into passage 34 from fluid inlet end 38. FIG. 4 illustrates member 52 in an uninstalled and uncompressed state. FIG. 5 illustrates member 52 in an installed and compressed state. When member 52 is pressed into passage 34, fingers 56 are bent inward, and a natural resilience of the materials from which member 52 is formed urges fingers 56 outward. This outward force clamps member 52 into position in passage 34. Fingers 56 may be formed to include bumps or pointed projections which aid inward deflection of fingers 56 during installation and cause fingers 56 to deflect a sufficient distance to achieve a desired clamping force.

Member 52 has a centrally located opening 58 in flange 54, so that flange 54 exhibits an annular shape. Member 52 is installed with flange 54 abutting inlet end 38 of body 28. Opening 58 has a diameter 60 which is sufficiently large to permit easy flow of fluid into passage 34 while blocking passage of plunger 36 out from body 28. Flange 54 also has an outer diameter 62.

Figure 6:
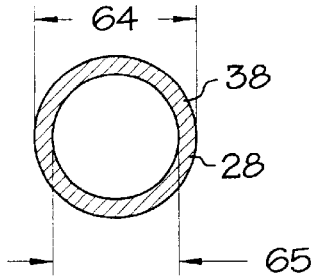
FIG. 6 shows a bottom end view of a portion of the second embodiment of the atomizing nozzle.

FIG. 6 shows a bottom end view of a portion of the second embodiment of atomizing nozzle 22 without member 52 installed therein. Referring to FIGS. 4–6, body 28 at inlet end 38 has an outer diameter 64 and an inner diameter 65 so that body 28 exhibits an annular cross sectional shape. In this preferred embodiment, outer diameter 62 of flange 54 is dimensioned smaller than outer diameter 64 of body 28 and larger than inner diameter 65 of body 28. Thus, flange 54 is dimensioned to abut against body 28 when installed and concurrently not interfere with the operation of threads 42 and the attachment of nozzle 22 to pipe 24.

In addition, fingers 56 extend for an axial length 66 within passage 34. Plunger 36 exhibits an axial length 68, and passage 34 exhibits an axial length 70 extending from orifice 30 to inlet end 38. Member 52 is desirably dimensioned so that the combined distance of axial length 66 of member 52 and axial length 68 of plunger 36 is less than the axial length 70 of passage 34. This dimensional consideration prevents member 52 from abutting plunger 36 during the operation of misting system 20 (FIG. 1) and clamping plunger 36 between member 52 and the top of passage 34. Accordingly, plunger 36 has sufficient room within passage 34 to move as required to achieve adequate atomization.

Accordingly, nozzle 22 configured in accordance with this second embodiment of the present invention exhibits enhanced life cycle characteristics. In particular, this second embodiment of nozzle 22 is simple and inexpensive due to the use of one-piece body 28 having atomizing orifice 30 formed therein and compressed elastic member 52. Member 52 and the junction between member 52 and body 28 resides within pipe 24 when nozzle 22 is attached to pipe 24. Accordingly, no fluid tight seal is required between member 52 and body 28. Moreover, the flow and pressure of fluid in misting system 20 tends to force member 52 against body 28. Accordingly, member 52 need not tightly grip body 28. Since member 52 need not tightly grip body 28, it may be constructed from inexpensive materials, such as molded plastic. Additionally, this design consideration permits member 52 to be easily removed from passage 34 and reinstalled back into passage 34. In other words, since member 52 may be removed to allow access to plunger 36 and both sides of orifice 30, this second embodiment of nozzle 22 is cleanable. This second embodiment has an enhanced life cycle since it is inexpensive to manufacture and purchase, and it is cleanable so that it need not be discarded when it becomes clogged.

Figure 7:
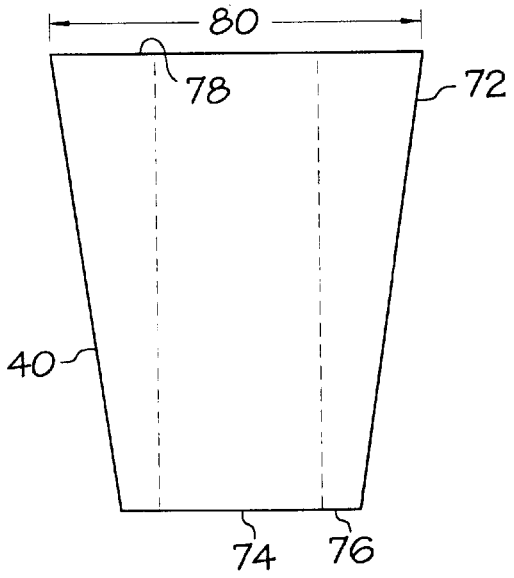
FIG. 7 shows a cross sectional side view of a compressed elastic member used in connection with a third embodiment of an atomizing nozzle configured in accordance with the present invention.
Figure 8:
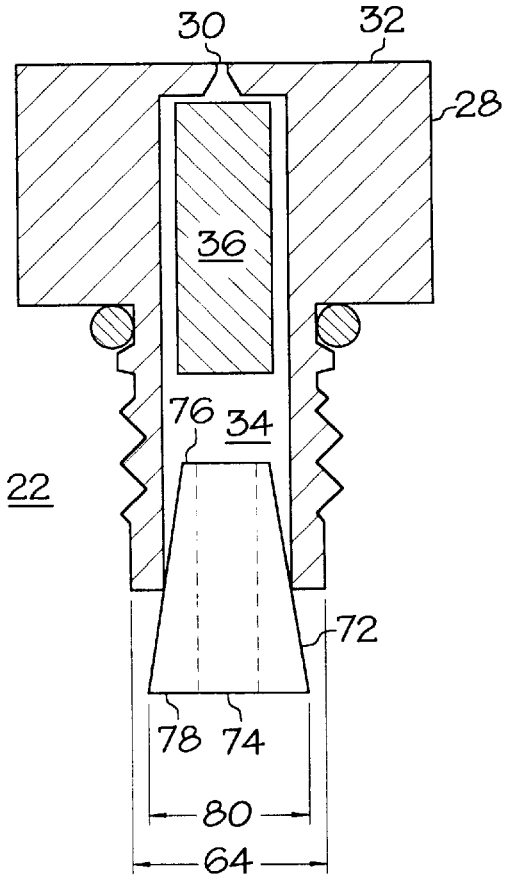
FIG. 8 shows a cross sectional side view of the third embodiment of the atomizing nozzle.

FIG. 7 shows a cross sectional side view of a compressed elastic member 72 used in connection with a third embodiment of an atomizing nozzle 22, and FIG. 8 shows a cross sectional side view of the third embodiment of atomizing nozzle 22. Referring to FIGS. 7 and 8, this third embodiment of nozzle 22 differs from the first and second embodiments discussed above in connection with FIGS. 2–6 due to the use of an alternate retainer 40. In particular, compressed elastic member 72 serves as retainer 40 in this third embodiment.

Member 72 has a truncated conical shape. In other words, member 72 is a compressible, hollow, wedge-shaped plug. An opening 74 extending axially through member 72 permits fluid to flow into passage 34. Member 72 tapers from a smaller end 76 to a larger end 78. In this third preferred embodiment, smaller end 76 is desirably smaller in diameter than inside diameter 65 (FIG. 6) of body 28. Larger end 78 desirably has a diameter 80 that is larger than inside diameter 65 of body 28 but smaller than outside diameter 64 of body 28 (FIG. 6).

After installing plunger 36 into passage 34 in this third embodiment, member 72 is press fit into inlet end 38 of body 28. As discussed above in connection with the second embodiment, member 72 need not be tightly pressed into passage 34 because the fluid flow and pressure urge member 72 into body 28 and no consequence results from leakage at the junction between member 72 and body 28. Desirably, an axial length dimension of member 72 is configured to prevent smaller end 76 of member 72 from abutting plunger 36 within passage 34. Fluid flows into passage 34 through opening 74, and plunger 36 has space to move so as to produce adequate atomization.

Accordingly, nozzle 22 as configured in accordance with this third embodiment of the present invention exhibits enhanced life cycle characteristics. In particular, this third embodiment of nozzle 22 is simple and inexpensive due to the use of one-piece body 28 having atomizing orifice 30 formed therein and compressed elastic member 72. Since member 72 need not tightly grip body 28, it may be constructed from inexpensive materials, such as materials commonly used in forming bottle stoppers. Additionally, this design consideration permits member 72 to be easily removed from passage 34 and reinstalled back into passage 34, allowing nozzle 22 to be cleanable. This third embodiment of the present invention has an enhanced life cycle because it is inexpensive to manufacture and purchase, and it is cleanable so that it need not be discarded when it becomes clogged.

Figure 9:
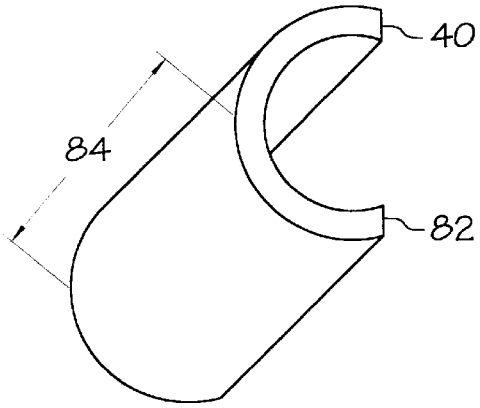
FIG. 9 shows a cross sectional perspective view of a compressed elastic member used in connection with a fourth embodiment of an atomizing nozzle configured in accordance with the present invention.

FIG. 9 shows a cross sectional perspective view of a compressed elastic member 82 used in connection with a fourth embodiment of atomizing nozzle 22. This fourth embodiment of nozzle 22 differs from the first, second, and third embodiments discussed above in connection with FIGS. 2–8 due to the use of an alternate retainer 40. In particular, compressed elastic member 82 serves as retainer 40 in this fourth embodiment.

Member 82 represents a leaf spring. In cross section, member 82 exhibits the shape of an arc which extends over an angular distance of more than 180°. This arc-shape extends over an axial length 84. As discussed above in connection with the second and third embodiments, axial length 84 is configured so that the combined length of axial length 84 of member 72 and axial length 68 of plunger 36 (FIG. 5) is shorter than axial length 70 (FIG. 5) of passage 34. This allows member 82 to be installed inside passage 34 with one end of member 82 flush to inlet end 38 of body 28 while the other end of member 82 does not abut plunger 36 (not shown).

After installing plunger 36 into passage 34 in this fourth embodiment, member 82 is press fit into inlet end 38 of body 28. Member 82 is slightly compressed in order to be able to slide into passage 34. Natural resilience of a material from which member 82 is formed urges member 82 to decompress, and this urging force causes member 82 to be clamped to body 28 within passage 34. As discussed above in connection with the second and third embodiments, member 82 need not be tightly clamped into passage 34. The width of member 82 is selected to block passage of plunger 36 while permitting fluid to freely flow within passage 34 beside member 82.

Accordingly, nozzle 22 as configured in accordance with this fourth embodiment of the present invention exhibits enhanced life cycle characteristics. In particular, this fourth embodiment of nozzle 22 is simple and inexpensive due to the use of one-piece body 28 having atomizing orifice 30 formed therein and compressed elastic member 82. Since member 82 need not be tightly clamped in place within passage 34, it may be easily removed from passage 34 and reinstalled back into passage 34, allowing nozzle 22 to be cleanable. This fourth embodiment of the present invention has an enhanced life cycle because it is inexpensive to manufacture and purchase, and it is cleanable so that it need not be discarded when it becomes clogged.

Figure 10:
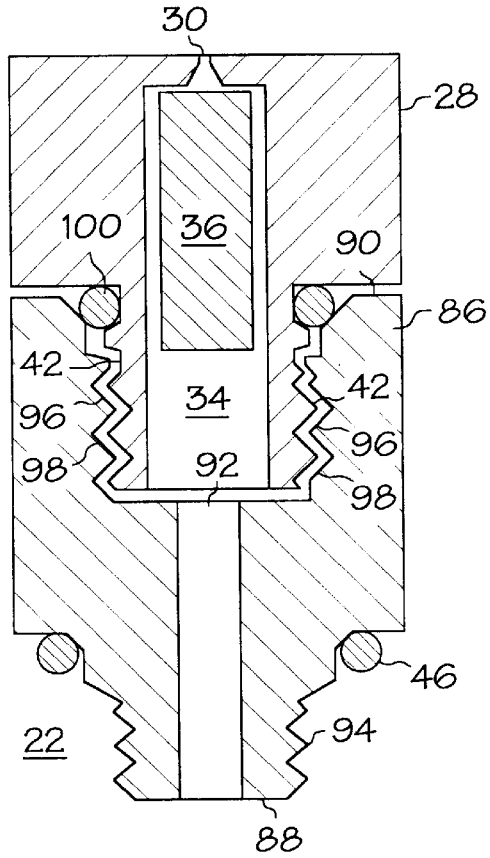
FIG. 10 shows a cross sectional side view of a fifth embodiment of an atomizing nozzle configured in accordance with the present invention.

FIG. 10 shows a cross sectional side view of a fifth embodiment of an atomizing nozzle 22. This fifth embodiment of nozzle 22 differs from the first through fourth embodiments discussed above in connection with FIGS. 2–9 due to the use of an alternate retainer 40. In particular, a hollow cap 86 serves as retainer 40 in this fourth embodiment.

Cap 86 has a fluid inlet end 88 and a fluid exit end 90, with an internal fluid passage 92 therebetween. Proximate fluid inlet end 88, cap 86 has a outwardly threaded nipple 94. O-ring 46 is positioned above nipple 94. Accordingly, nipple 94 of cap 86 attaches to pipe 24 (FIG. 1) by a threaded engagement, and O-ring 46 insures a fluid tight seal between cap 86 and pipe 24.

Proximate fluid exit end 90, cap 86 has an interior wall 96 on which inwardly extending threads 98 are formed. Passage 92 has a narrower portion proximate inlet end 88 of cap 86 and a wider portion proximate exit end 90. The wider portion is dimensioned so that threads 98 on interior wall 96 mate with threads 42 on body 28. An O-ring 100 is positioned between body 28 and cap 86 within this wider portion of passage 92 to insure a fluid-tight seal between cap 86 and body 28. The narrower portion of passage 92 is dimensioned to permit easy fluid flow through passage 92 into passage 34 of body 28 while blocking passage of plunger 36.

After installing plunger 36 into passage 34 in this fifth embodiment, cap 86 is threadably mated to body 28. Cap 86 is then threadably mated to pipe 24 to attached nozzle 22 into misting system 20 (see FIG. 1).

Accordingly, nozzle 22 as configured in accordance with this fifth embodiment of the present invention exhibits enhanced life cycle characteristics. In particular, this fifth embodiment of nozzle 22 is simple and inexpensive due to the use of one-piece body 28 having atomizing orifice 30 formed therein and cap 86. The threaded engagement of body 28 to cap 86 provides a releasable attachment. Cap 86 may be easily removed from body 28 by unscrewing and may be reinstalled back onto body 28 by screwing, allowing nozzle 22 to be cleanable. This fifth embodiment of the present invention has an enhanced life cycle because it is easily disassembleable and cleanable so that it need not be discarded when it becomes clogged.

Figure 11:
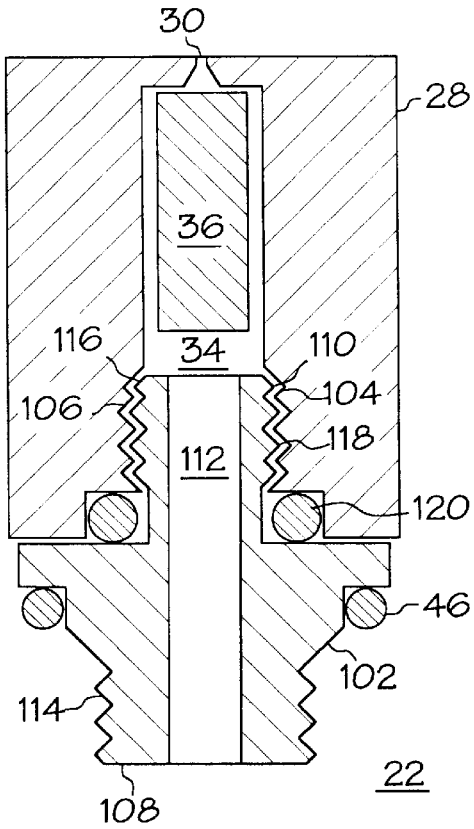
FIG. 11 shows a cross sectional side view of a sixth embodiment of an atomizing nozzle configured in accordance with the present invention.

FIG. 11 shows a cross sectional side view of a sixth embodiment of an atomizing nozzle 22. This sixth embodiment of nozzle 22 differs from the first through fifth embodiments discussed above in connection with FIGS. 2–10 due to the use of an alternate retainer 40. In particular, a hollow plug 102 serves as retainer 40 in this fourth embodiment.

In addition, an interior wall portion 104 of body 28 in passage 34, which resides near fluid inlet end 38 of body 28, has inwardly formed threads 106 formed thereon rather than outwardly formed threads 42 (FIG. 2) discussed above.

Plug 102 has a fluid inlet end 108 and a fluid exit end 110, with an internal fluid passage 112 therebetween. Proximate fluid inlet end 108, plug 102 has a outwardly threaded nipple 114. O-ring 46 is positioned above nipple 114. Accordingly, nipple 114 of plug 102 attaches to pipe 24 (FIG. 1) by a threaded engagement, and O-ring 46 insures a fluid tight seal between plug 102 and pipe 24.

Proximate fluid exit end 110, plug 102 has an outer wall 116 on which outwardly extending threads 118 are formed. Outer wall 116 is dimensioned so that threads 118 on outer wall 116 mate with threads 106 on inner wall 104 of body 28. An O-ring 120 is positioned between body 28 and plug 102 to insure a fluid-tight seal between plug 102 and body 28. Passage 112 of plug 102 is dimensioned to permit easy fluid flow through passage 112 into passage 34 of body 28. However, the portion of plug 102 at outer wall 110 is dimensioned to block passage of plunger 36.

After installing plunger 36 into passage 34 in this sixth embodiment, plug 102 is threadably mated to body 28. Plug 102 is then threadably mated to pipe 24 to install nozzle 22 into misting system 20 (see FIG. 1).

Accordingly, nozzle 22 configured in accordance with this sixth embodiment of the present invention exhibits enhanced life cycle characteristics. In particular, this sixth embodiment of nozzle 22 is simple and inexpensive due to the use of one-piece body 28 having atomizing orifice 30 formed therein and plug 102. The threaded engagement of body 28 to plug 102 provides a releasable attachment. Plug 102 may be easily removed from body 28 by unscrewing and may be reinstalled back onto body 28 by screwing, allowing nozzle 22 to be cleanable. This sixth embodiment of the present invention has an enhanced life cycle because it is inexpensive to manufacture and purchase, and it is cleanable so that it need not be discarded when it becomes clogged.

In summary, the present invention provides an improved atomizing nozzle with enhanced life cycle characteristics. An atomizing nozzle plunger is inserted into its passage within the nozzle from a fluid inlet end of the nozzle. Both the plunger passage and atomizing fluid exit orifice are formed in a one-piece body. As a result, an atomizing nozzle which is inexpensive to manufacture and purchase and/or is cleanable is provided.

Although the preferred embodiments of the invention have been illustrated and described in detail, it will be readily apparent to those skilled in the art that various modifications may be made therein without departing from the spirit of the invention or from the scope of the appended claims.

What is claimed is:

1. An enhanced life cycle atomizing nozzle comprising:

a hollow one-piece body having an exit end and an inlet end, said exit end having an orifice of a first diameter that connects to a passage having a second diameter, said second diameter being larger than said first diameter, and said passage extending from said orifice to said inlet end;

a free floating plunger residing in said passage, said plunger having a diameter larger than s aid first diameter and smaller than said second diameter; and means, for retaining said plunger in said passage, wherein said retaining means is integrally formed with said body at said inlet end of said body.

2. An atomizing nozzle as claimed in claim 1 wherein said retaining means is crimped to permit fluid flow while blocking passage of said plunger.

3. An atomizing nozzle as claimed in claim 1 wherein:

said inlet end of said body has outwardly formed threads encompassing a predetermined cross sectional area; and said retaining means has an outer wall surrounding an area smaller than said predetermined cross sectional area.

4. An enhanced life cycle atomizing nozzle comprising:

a hollow one-piece body having an exit end and an inlet end, said exit end having an orifice of a first diameter that connects to a passage having a second diameter, said second diameter being larger than said first diameter, said passage extending from said orifice to said inlet end, and said inlet end having outwardly formed threads encompassing a predetermined cross sectional area;

a free floating plunger residing in said passage, said plunger having a diameter larger than said first diameter and smaller than said second diameter; and retaining means, integrally formed with said body at said inlet end thereof, for retaining said plunger in said passage, said retaining means having an outer wall surrounding an area smaller than said predetermined cross sectional area and said retaining means being crimped to permit fluid flow while blocking passage of said plunger.

* * * * *